US005423135A

United States Patent [19]

Poole et al.

[11] Patent Number: 5,423,135

[45] Date of Patent: Jun. 13, 1995

[54] OUTSOLE FOR BOATING SHOES HAVING FLATTENED SINE WAVE INCISION

[75] Inventors: Charles Poole, Durham, N.H.; Gary Duclos, Newburyport, Mass.

[73] Assignee: The Timberland Company, Stratham, N.H.

[21] Appl. No.: 727,842

[22] Filed: Jul. 9, 1991

[51] Int. Cl.[6] ..... A43B 13/00; A43B 23/28

[52] U.S. Cl. ..... 36/25 R; 36/59 C; 36/59 R; 36/116

[58] Field of Search ..... 36/59 C, 32 R, 116, 36/59 R, 107, 25 R, 108, 76 R; D2/320

[56] References Cited

U.S. PATENT DOCUMENTS

| | | | |
|---|---|---|---|
| D. 262,582 | 1/1982 | Moore | D2/320 X |
| D. 321,588 | 11/1991 | Issler | D2/320 |
| 1,051,880 | 2/1913 | Glenn | 36/108 X |
| 2,162,912 | 7/1939 | Craver | 36/59 |
| 3,824,716 | 7/1974 | Di Paolo | 36/32 R |
| 3,971,145 | 7/1976 | Stegerwald | 36/32 R |
| 4,724,624 | 2/1988 | Duclos | 36/116 |
| 4,910,887 | 3/1990 | Turner et al. | 36/8.1 X |

FOREIGN PATENT DOCUMENTS

| | | | |
|---|---|---|---|
| 2540360 | 10/1984 | France . | |
| 2284289 | 4/1986 | France . | |
| 545994 | 6/1942 | United Kingdom . | |
| 770588 | 3/1957 | United Kingdom . | |
| 8303528 | 10/1983 | WIPO | 36/59 C |

OTHER PUBLICATIONS

Bulletin Officiel De La Propriété Industrielle, FR 2 284 289 date 12 Sep. 1975 (2 pages including the cover page).

*Primary Examiner*—Steven N. Meyers
*Assistant Examiner*—BethAnne Cicconi

[57] ABSTRACT

A sole construction for use with a boating shoe or the like comprises an outsole having a multiplicity of wave-like incisions in a traction area. The incisions are each in the form of a flattened sine wave and extend generally transverse to the longitudinal axis of the sole. A plurality of straight incisions intersect the wave-like incisions and extend substantially parallel to the longitudinal axis of the sole. The sole may further include inner and outer traction areas in which a plurality of incisions intersect wave-like incisions extending parallel to the longitudinal axis of the shoe, with the straight incisions extending substantially transverse to the longitudinal axis.

13 Claims, 2 Drawing Sheets

OUTSOLE FOR BOATING SHOES HAVING FLATTENED SINE WAVE INCISION

The present invention relates to a shoe sole and, in particular to an outsole for a boating shoe which provides improved traction on wet surfaces.

BACKGROUND OF THE INVENTION

The best traction on a flat dry surface is provided by a flat outsole made of a rubber or other elastic material which provides good traction. Such a construction, however, provides very poor traction on a wet surface and it has been known for many years to impart various patterns of grooves and/or incisions (siping) to improve the traction of rubber soles on wet surfaces as inevitably encountered in boating.

Molded grooves permit water to flow away from the supporting surface thereby improving the traction between the surface and shoe sole. A multiplicity of incisions also provides sharp surfaces when the sole is flexed which tend to cut through the water. Currently, the most popular form of boating moccasin includes a multiplicity of incisions in the form of a triangular wave over the entire traction surface of the moccasin.

OBJECT OF THE INVENTION

The main object of the present invention is to provide a shoe sole with improved traction on a web surface.

A more specific object of the invention is to provide an improved siping arrangement for an outsole in which traction on wet surfaces is improved in all directions.

SUMMARY OF THE INVENTION

According to the invention, a multiplicity of wave-like incisions are formed in an outsole running generally from side to side, i.e., transverse to the longitudinal axis of the sole. Each of the incisions is in the form of a clipped or flattened sine wave. In addition, substantially straight incisions are formed across the flattened sine waves forming a multiplicity of blocks, the edges of which are defined by adjacent straight incisions and adjacent flattened wave-like incisions.

In a preferred embodiment, the foregoing siping design is cut into the central traction areas of the forward and heel portions of the sole. On the edges of the toe and ball areas of the sole, the same siping arrangement is used but, in these areas, the wave-like incisions run generally in the direction of the longitudinal axis of the sole.

In the Drawings

Detailed Description

Figure 1:
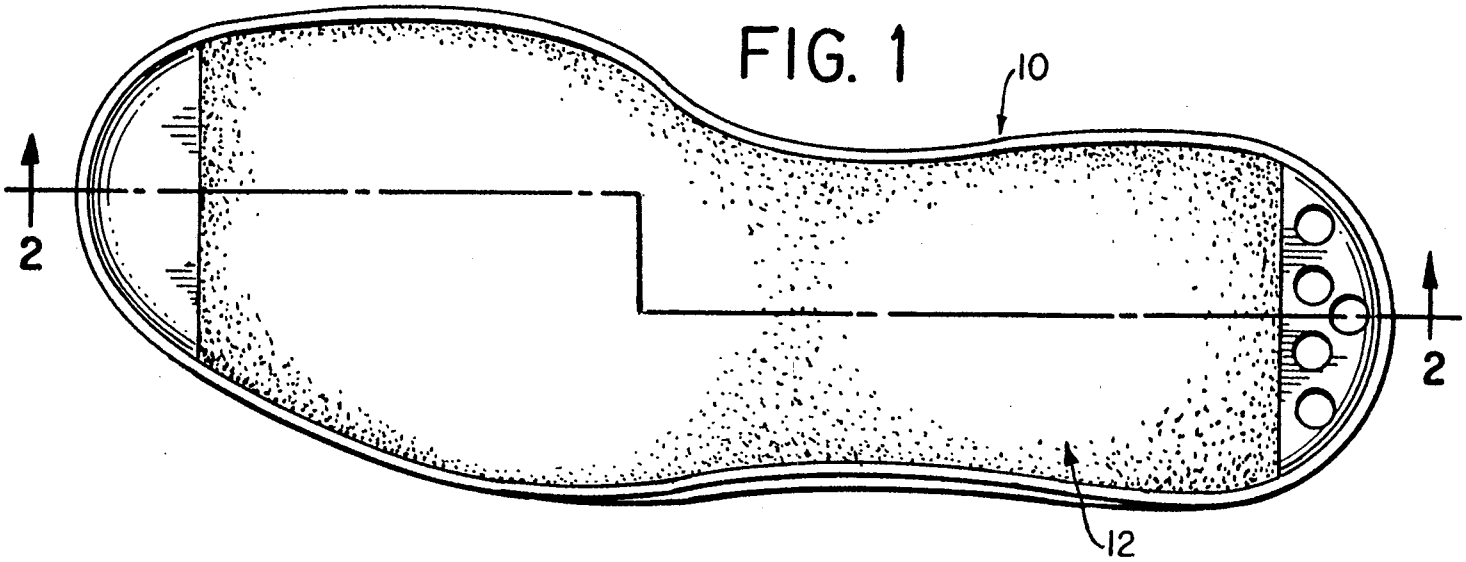
FIG. 1 is a top plan view of a shoe sole according to a preferred embodiment of the invention.
Figure 2:
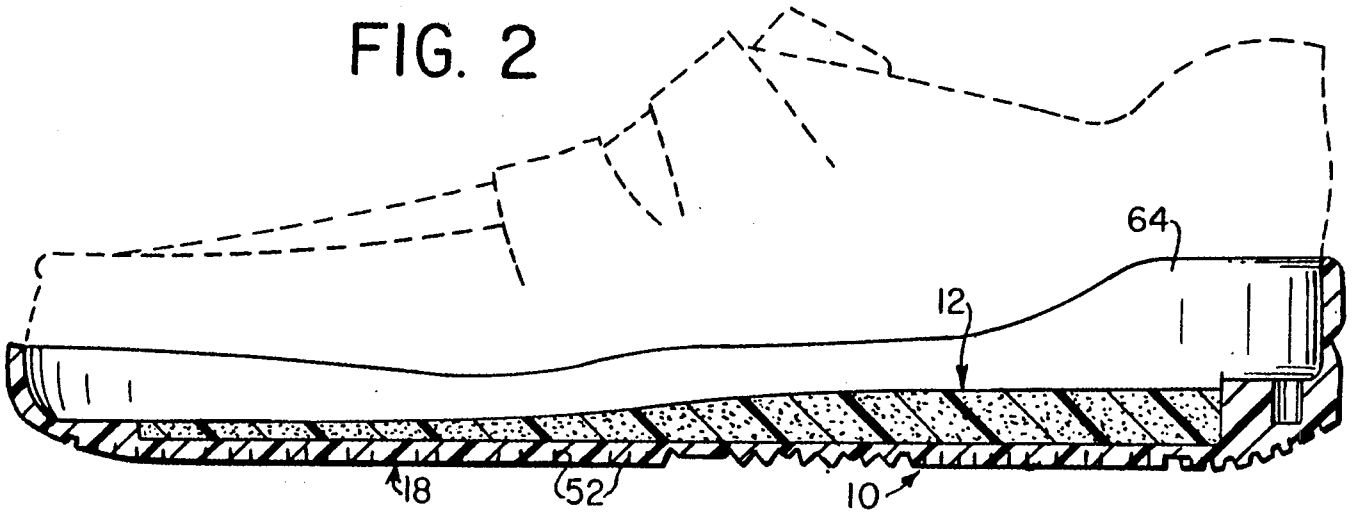
FIG. 2 is a side sectional view along the line 2—2 of FIG. 1.

In the preferred embodiment of the invention, the sole is intended to be used with a boating shoe and, in particular, a hand sewn leather moccasin as shown in phantom lines (not numbered) in FIG. 2. However, the type of shoe is not a feature of the invention; therefore, the construction of the shoe upper is not described herein in detail. By way of example only, it is contemplated that an outsole in accordance with the invention may be employed with the shoe construction illustrated in U.S. patent application Ser. No. 07/724,429 entitled "Shoe With Foot Stabilizing Device" filed on Jul. 3, 1991 in the name of Guillaume Sacre.

Referring to the drawings, a shoe sole in accordance with the invention comprises a rubber or plastic outsole 10 bonded by cementing to a shock attenuating cushion 12. Grooves 14 and 16 are molded into the toe and ball areas of outsole 10 to define a central traction area 18, inner traction areas 22, 24 and 26 and outer traction areas 28, 30 and 32. The inner traction areas 22, 24 and 26 are separated by portions of the groove 16 and, likewise, the outer traction areas 28, 30 and 32 are separated by portions of the groove 14.

The heel portion of the hard rubber outsole 10 includes similar molded grooves 34, 36, 38 and 40 running generally parallel to the longitudinal axis of the sole, and molded grooves 42 and 44 running from edge to edge across the heel portion of the sole. This defines a central traction area 46 and inner and outer traction areas 48 and 50 in the heel portion of the sole.

The siping arrangement in accordance with the invention appears in each of the above identified traction areas, the siping design in the traction areas 18, 46, 48 and 50 being identical. As shown most clearly in the enlarged view of FIG. 4, the siping pattern consists of a multiplicity of wave-like incisions 52 each of which is in the form of a flattened sine wave. The incisions 52 are formed by a multiplicity of knives in the shape of the desired flattened sine waves. Incisions 52 run essentially from edge to edge across the sole, essentially transverse to the longitudinal axis of the sole. In addition, a plurality of straight incisions 54 running substantially parallel to the longitudinal axis of the shoe intersect the wave-like incisions 52 at each repeat of the sine wave. This, in effect, forms blocks defined by adjacent straight incisions 54 and adjacent wave-like incisions 52. One of the multiplicity of blocks formed is shown by cross hatching in FIG. 4 and is identified by the numeral 56.

Figure 3:
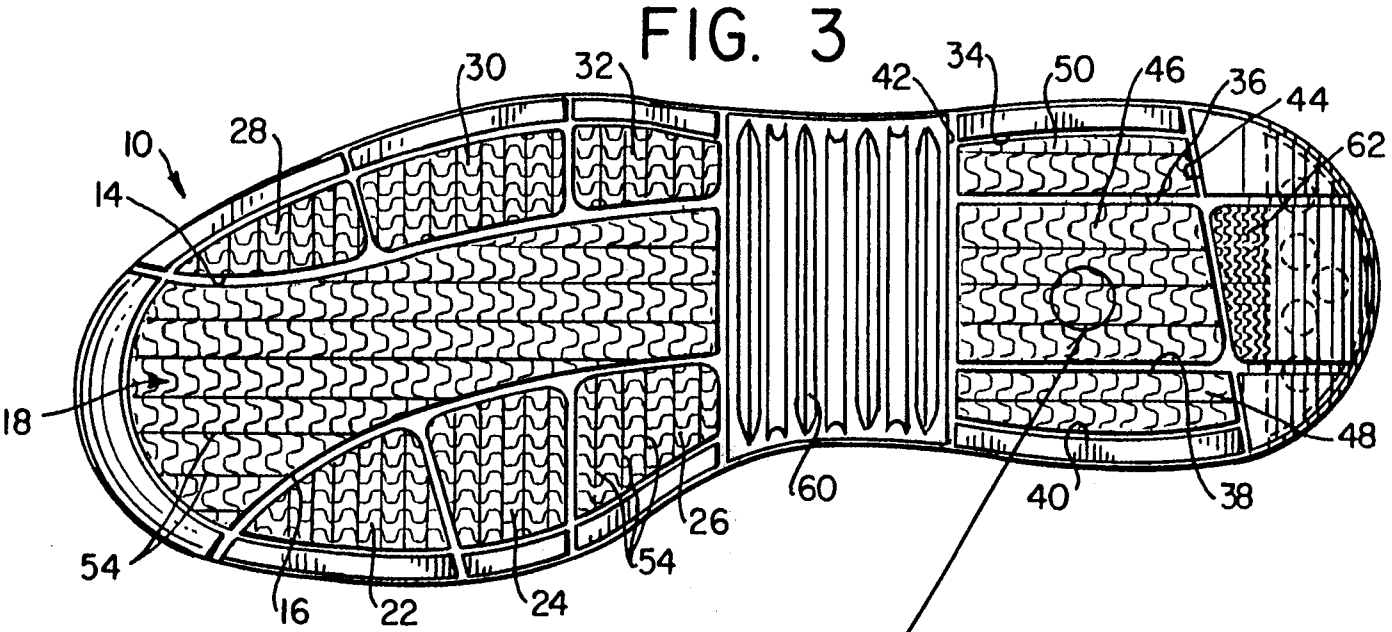
FIG. 3 is a bottom plan view of a preferred embodiment of an outsole in accordance with the invention.
Figure 4:
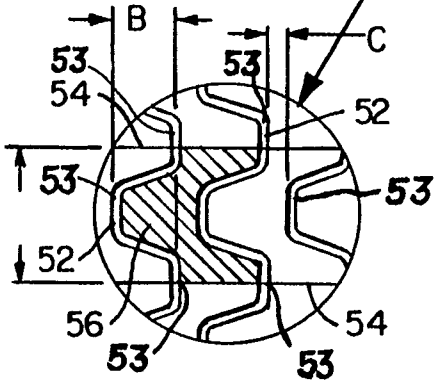
FIG. 4 is a magnified view showing the shape of the blocks formed by the wave-like and straight incisions.

As can be seen in FIG. 4, the peaks and valleys of the sine wave form are flattened to define elongated portions 53. These elongated portions are shown in FIG. 3 extending generally transversely to the direction of elongation of the outsole within the inner traction area and extending generally parallel to the direction of elongation of the outsole within the outer traction areas.

Essentially the same siping pattern appears in the inner and outer traction areas 22, 24, 26 and 28, 30, 32, respectively, except in these cases the wave-like incisions run generally parallel to the longitudinal axis of the sole whereas the straight incisions 54 run transverse to the longitudinal sole axis. Moreover, in the side traction areas 22, 24, 26, 28, 30 and 32, a smaller siping pattern is used, i.e., the "waves" are smaller and closer together, and adjacent incisions are slightly closer to each other than in the traction areas 18, 46, 48 and 50.

The siping pattern which forms the basis of the invention may be continued across the entire sole but it is not necessary that the entire sole contain siping. Decorative and/or other types of gripping surfaces such as the M-shaped grooves 60 in the medial region and undulating grooves 62 at the back of the heel may be provided. The sole may be flat or it may include a raised rim 64 into which a stitching line (not shown) is molded for attachment of the sole to the shoe upper. The outsole according to the invention may be attached to the shoe upper by conventional means which, therefore, is not described in detail.

As in other forms of siping designs, improved traction is provided when the wearer's foot causes the sole to flex which opens the incisions (depending on the way in which, the sole flexes) producing a multiplicity of sharp edges that cut through a layer of water on an underlying surface such as a boat deck. By providing wave-like incisions in the form of a clipped or flattened sine wave a larger number of leading edges are provided and the traction of the sole is enhanced as compared to other types of siping designs. The opening of the incisions caused by flexing of the sole also tends to channel the water away from the wet surface. By providing the transverse incision 54, traction in the side to side direction is enhanced. The individual blocks 56 formed by the transverse siping are comparable to the blocks of a tire tread when the sole is flexed in any direction.

In addition to softening shocks, the EVA cushion 12 improves the flexibility of the hard rubber outsole 10. This, in turn, enhances the flexing action of the sole which further tends to improve traction on wet surfaces.

As indicated above, the siping pattern shown in the central traction area 18 may be continued over the entire surface of the outsole; however, to further enhance traction in the side to side direction, the siping in the inner traction areas 22, 24, 26 and the outer traction areas 28, 30, 32 is transverse to the siping in the central areas 18 and 46. Flexing of the sole about the longitudinal axis opens the incisions 52 in these inner and outer traction areas providing greater traction in these areas in side to side directions.

Empirical observations indicate that there are optimum dimensions for the siping pattern. In the first place, it is necessary that the blocks 56 be large enough so that the blocks will not fall out of the sole during the siping process or during normal use. Good results have been achieved with a sole construction having the dimensions stated below (with reference to FIG. 4).

| Large Siping Pattern (Areas 18, 46, 48, 50) | |
|---|---|
| A | 7.8 mm |
| B | 3.2 mm |
| C | 5.3 mm |
| Small Siping Pattern (Areas 22, 24, 26, 28, 30, 32) | |
| A | 4.9 mm |
| B | 2.6 mm |
| C | 3.0 mm |

The outsole 12 may be 4 mm thick with the siping incisions cut to a depth of 2.25 mm. A preferred material for outsole 12 is rubber having the following characteristics:

50 shore A durometer±5
specific gravity—1.15
tensile strength—1800–2000 lbs
elongation—500%
NBS abrasion minimum—150

It is advantageous to have the wave-like incisions formed by straight lines, ideally in the shape of a square wave but it is not possible to form a cutting edge with perfectly straight lines; therefore, some curve is necessary, particularly at the corners. The larger the "cycle" of the wave the easier it is to provide a straight edge but, conversely, the smaller the cycle and the closer the incisions, the greater the traction. Thus, a tradeoff is involved and the foregoing dimensions are based on tests of various different siping designs.

The incisions 52 and 54 are preferably so narrow as to be virtually invisible when the sole is flat with the edges of the incisions contacting each other; however, when the sole flexes, the relatively sharp edges defining the incisions are exposed and brought into direct contact with the surface supporting the sole providing a multiplicity of sharp surfaces and small recesses into which the water can be channeled.

What is claimed is:

1. A sole construction for use with a boating shoe, comprising an elongated outsole having at least one traction area and longitudinal gripping means for providing traction in a direction of elongation of said outsole, said longitudinal gripping means including a siping pattern forming a multiplicity of wave-like incisions spaced from each other in said traction area, said incisions each defining an incised path in said traction area, said incised paths each extending generally transverse to the direction of elongation of the outsole and resembling a flattened sine wave having peaks and valleys which are flattened to define respective elongated portions which extend generally transverse to the direction of elongation of the outsole, said incisions each forming a multiplicity of opposing sharp edges which contact each other when the outsole is flat and which separate in response to flexing of the outsole to expose the multiplicity of said opposing sharp edges for cutting through a layer of water on an underlying wet surface and for channelling the water between the opposing sharp edges so that the water flows away from the wet surface.

2. A sole construction according to claim 1, further including a plurality of straight incisions intersecting said wave-like incisions, said straight incisions running substantially parallel to the direction of elongation of the outsole.

3. A sole construction according to claim 2, wherein said traction area constitutes an inner traction area, the outsole further comprising a plurality of outer traction areas separated from said inner traction area by respective grooves, further comprising a plurality of wave-like incisions substantially parallel to the direction of elongation of the outsole in at least one of said outer traction areas of the outsole.

4. A sole construction according to claim 2, wherein said traction area constitutes an inner traction area, the outsole further comprising a plurality of outer traction areas separated from said inner traction area by respective grooves, further comprising a plurality of wave-like incisions in said outer traction areas each extending substantially parallel to the direction of elongation of the outsole and resembling a flattened sine wave.

5. A sole construction according to claim 4, wherein said traction area constitutes an inner traction area, the outsole further comprising a plurality of outer traction areas separated from said inner traction area, said outer traction areas further including a plurality of straight incisions intersecting said wave-like incisions, said straight incisions running substantially transverse to the direction of elongation of the outsole.

6. A sole construction according to claim 5, wherein said outsole includes molded grooves separating the inner and outer traction areas from each other.

7. A sole construction according to claim 1, further including a shock attenuating cushion bonded to an upper surface of said outsole.

8. A sole construction according to claim 1, further comprising side to side gripping means for providing traction in a side to side direction generally transverse to the direction of elongation of said outsole, said side to side gripping means including a siping pattern in the form of a plurality of incisions spaced from each other and defining respective incised paths each extending generally in the same direction as the direction of elongation of the outsole.

9. A sole construction according to claim 8, wherein said siping pattern of each of said respective incised paths of said side to side gripping means includes wave-like incisions each resembling a flattened sine wave having peaks and valleys which are flattened.

10. A sole construction according to claim 8, wherein said siping pattern of each of said respective incised paths of said side to side gripping means includes straight incisions each running substantially transverse to the direction of elongation of the outsole, said longitudinal and side to side gripping means defining a plurality of blocks.

11. A sole construction according to claim 1, wherein said outsole is comprised of between 45 to 55 shore A durometer rubber.

12. A sole construction according to claim 11, wherein said outsole has a specific gravity of 1.15, a tensile strength between 1800 and 2000 pounds, an elongation of 500 percent and an NBS abrasion minimum of 150.

13. A sole construction according to claim 2, wherein said outsole is comprised of between 45 to 55 shore A durometer rubber.

* * * * *